US007621077B1

(12) United States Patent
Perina et al.

(10) Patent No.: US 7,621,077 B1
(45) Date of Patent: Nov. 24, 2009

(54) HINGED POLE APPARATUS

(75) Inventors: Mark J. Perina, Omaha, NE (US); Carl J. Macchietto, Omaha, NE (US)

(73) Assignee: Valmont Industries, Inc., Valley, NE (US)

( * ) Notice: Subject to any disclaimer, the term of this patent is extended or adjusted under 35 U.S.C. 154(b) by 590 days.

(21) Appl. No.: 11/227,644

(22) Filed: Sep. 15, 2005

(51) Int. Cl.
*B66C 23/06* (2006.01)
*B66C 23/62* (2006.01)

(52) U.S. Cl. ..... 52/116; 52/119; 52/123.1

(58) Field of Classification Search ..... 52/116, 52/117, 119, 123.1, 721.2, 726.4, 749; 362/431
See application file for complete search history.

(56) References Cited

U.S. PATENT DOCUMENTS 2,510,717 A * 6/1950 Roos ..... 269/46
3,995,701 A * 12/1976 Kelly, Jr. ..... 173/191
4,220,981 A * 9/1980 Koether ..... 362/486
4,878,160 A * 10/1989 Reneau et al. ..... 362/269
4,903,442 A * 2/1990 Trommen ..... 52/116
5,257,489 A * 11/1993 Angelette ..... 52/295
5,772,172 A * 6/1998 Sampedro et al. ..... 248/415
5,794,387 A * 8/1998 Crookham ..... 52/122.1
6,685,154 B1 * 2/2004 Blyth et al. ..... 248/512

FOREIGN PATENT DOCUMENTS

GB 911784 11/1962
GB 968113 8/1964
GB 1067267 5/1967
GB 1084779 9/1967
GB 1460025 12/1976
GB 206021 A 4/1981
GB 2205392 B 3/1992

* cited by examiner

*Primary Examiner*—Richard E Chilcot, Jr.
*Assistant Examiner*—Chi Q Nguyen
(74) *Attorney, Agent, or Firm*—Dennis L. Thomte; Thomte Patent Law Office LLC

(57) ABSTRACT

A hinged pole having a base plate secured to the lower end thereof with the base plate having a plurality of upstanding brackets secured thereto. A cart is provided which is mounted on the foundation of the pole and is secured thereto and which is connected to the pole. The cart includes a power cylinder which is connected to the pole and which is used to lower the pole from its upstanding position to a horizontal position. The pole may be serviced when the pole is in its horizontal position. When the servicing of the pole has been completed, the pole is raised to its upright position and re-secured to the foundation therefore. The cart is then removed from the pole for use at a different location.

10 Claims, 9 Drawing Sheets

HINGED POLE APPARATUS

BACKGROUND OF THE INVENTION

1. Field of the Invention

This invention relates to a hinged pole apparatus and more particularly a hinged pole together with an apparatus for raising and lowering the pole with respect to its foundation.

2. Description of the Related Art

When the luminaire on a light pole or the like requires servicing, service personnel must use an aerial lift or the like to gain access to the luminaire. In some cases, the pole must be lowered to the ground for servicing and the same requires a crane or the like to lift the pole from its foundation and lower the same onto the ground. When the service repairs have been made, the crane must then again lift the pole onto its foundation.

Many prior art hinged poles have been provided but they are thought to be cumbersome to use. Further, the means for hinging the prior art poles is a permanent part of the pole which increases the overall cost of the pole.

SUMMARY OF THE INVENTION

A hinged pole apparatus is described which enables a pole to be hingedly moved from its normal upright position to a horizontal position to facilitate servicing of the luminaire or the like on the upper end of the pole. The pole of this invention has a base plate secured to the lower end thereof. The pole is mounted on a foundation having an upper surface with a first array of anchor bolts secured to the foundation which extend upwardly therefrom. A second array of anchor bolts is secured to the foundation laterally outwardly of the first array of anchor bolts. The base plate of the pole has an array of anchor bolt openings formed therein corresponding to the first array of anchor bolts whereby the base plate of the pole may be mounted on the first array of anchor bolts. Threaded nuts are provided on the first array of anchor bolts which secure the base plate to the first array of anchor bolts. The base plate has a plurality of upstanding brackets provided thereon.

A transportable cart forms a part of the invention and includes a frame, having upper and lower ends, which is selectively positioned on the foundation at least partially around the lower end of the pole. The lower end of the frame is selectively secured to the second array of anchor bolts. Elongated linkages are provided on the lower end of the frame which are selectively secured to the upstanding brackets on the base plate. In the preferred embodiment, a power cylinder such a hydraulic cylinder is pivotally secured, intermediate its length, to the upper end of the frame about a horizontal axis. The rod end of the power cylinder is selectively connected to the pole above the lower end thereof to enable the pole to be hingedly moved with respect to the foundation and the cart. The hydraulic cylinder selectively hingedly moves the pole, between raised and lowered positions, when the threaded nuts are removed from the first array of anchor bolts, the linkages on the frame have been secured to the upstanding brackets on the base plate, the actuator has been secured to the pole above the base plate, and the lower end of the frame has been secured to the second array of anchor bolts.

In the preferred embodiment, an integrated power unit source for the hydraulic cylinder is provided on the cart to supply hydraulic fluid under pressure to the hydraulic cylinder. The cart may be moved from pole location to pole location as required.

It is therefore a principal object of the invention to provide an improved hinged pole.

A further object of the invention is to provide an improved hinged pole and an apparatus for hingedly moving the pole between raised and lowered positions.

Still another object of the invention is to provide an apparatus for hingedly moving a hinged pole between raised and lowered positions wherein the apparatus may be moved from pole location to pole location.

Still another object of the invention is to provide a means for conveniently lowering a pole from its upright position to enable servicing of the pole and its associated components These and other objects will be apparent to those skilled in the art.

DETAILED DESCRIPTION OF THE INVENTION

Figure 1:
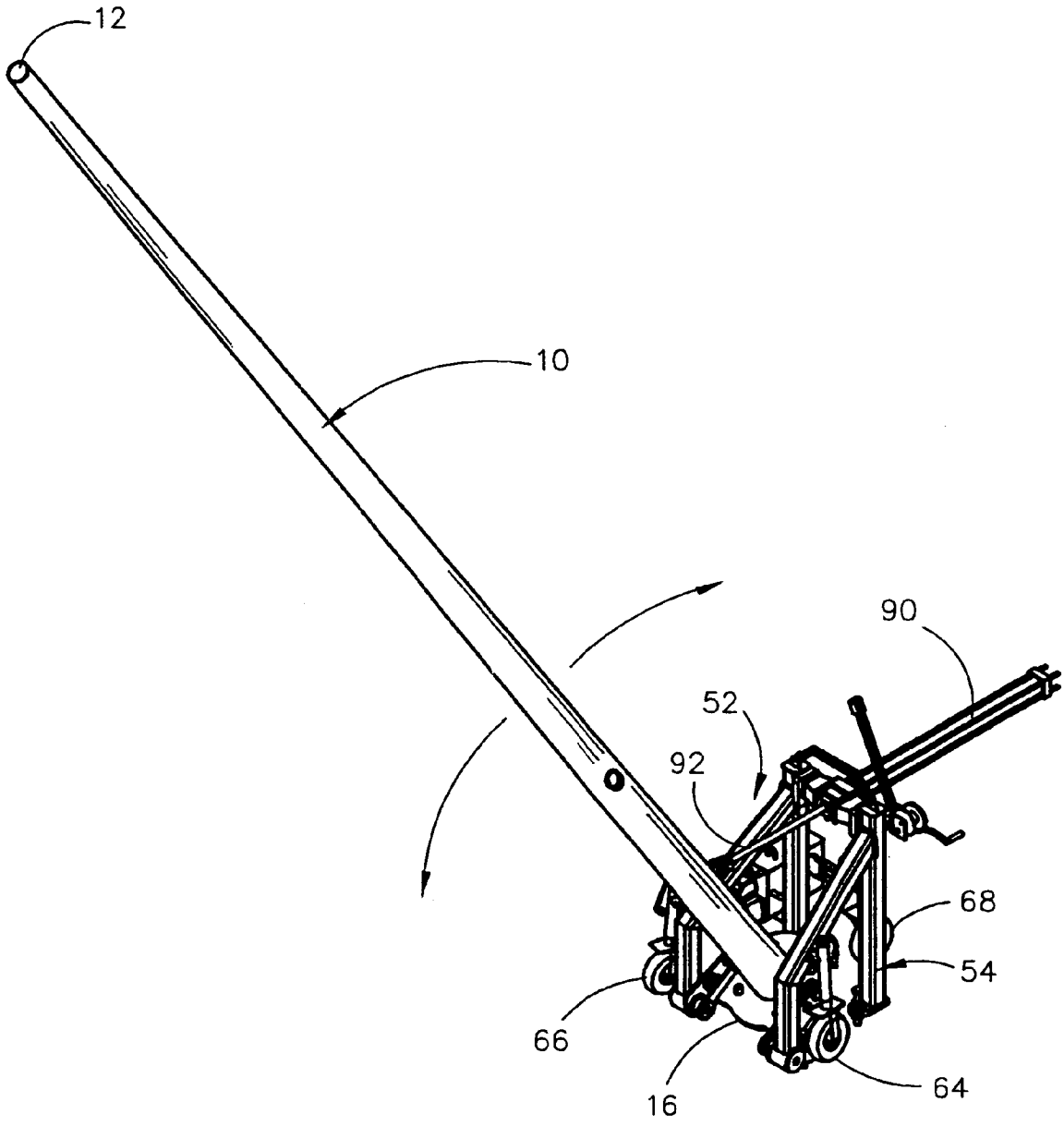
FIG. 1 is a perspective view illustrating the hinged pole of this invention together with the apparatus for raising and lowering the pole.
Figure 2:
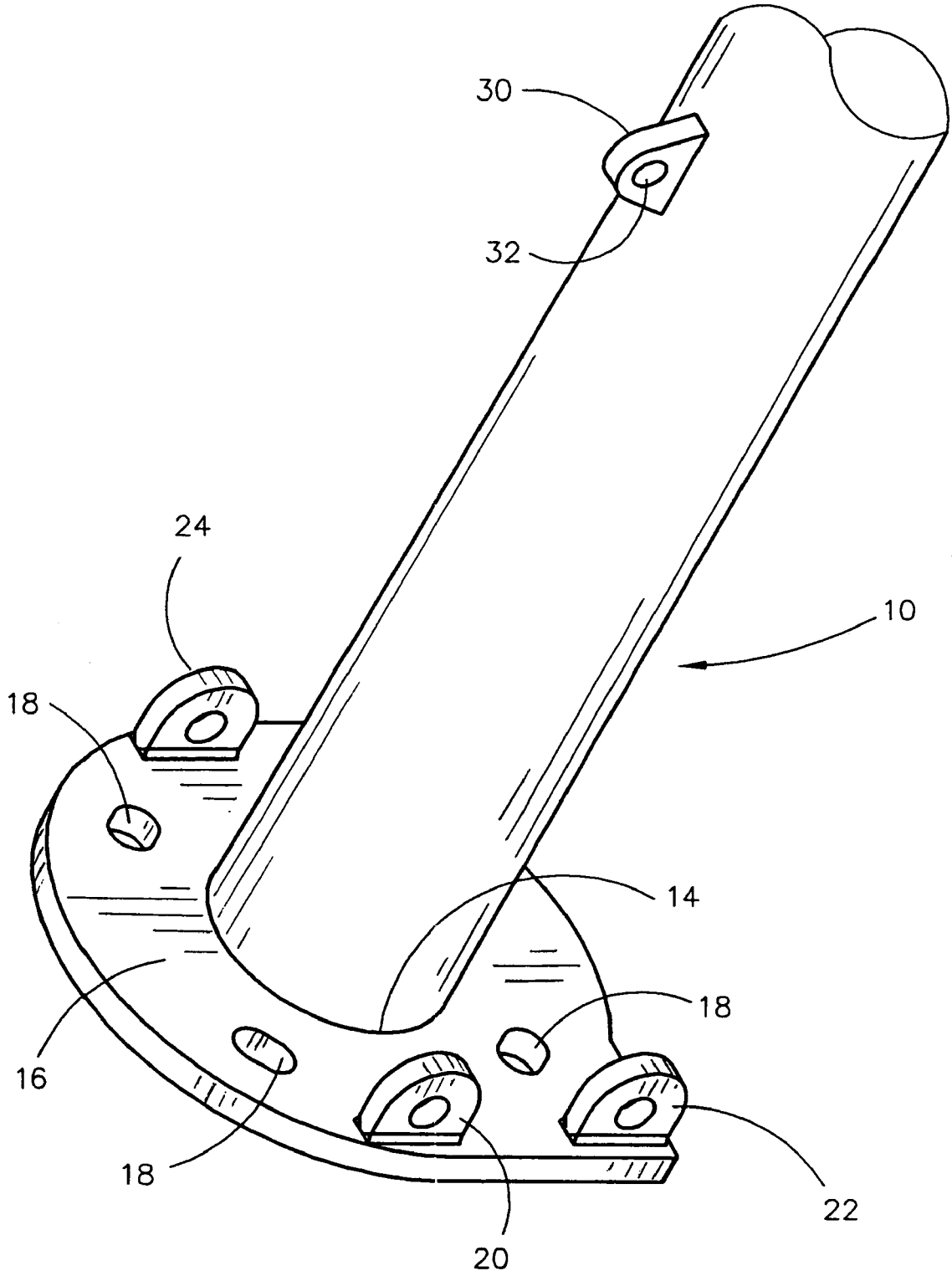
FIG. 2 is a perspective view of the lower end of the pole.
Figure 3:
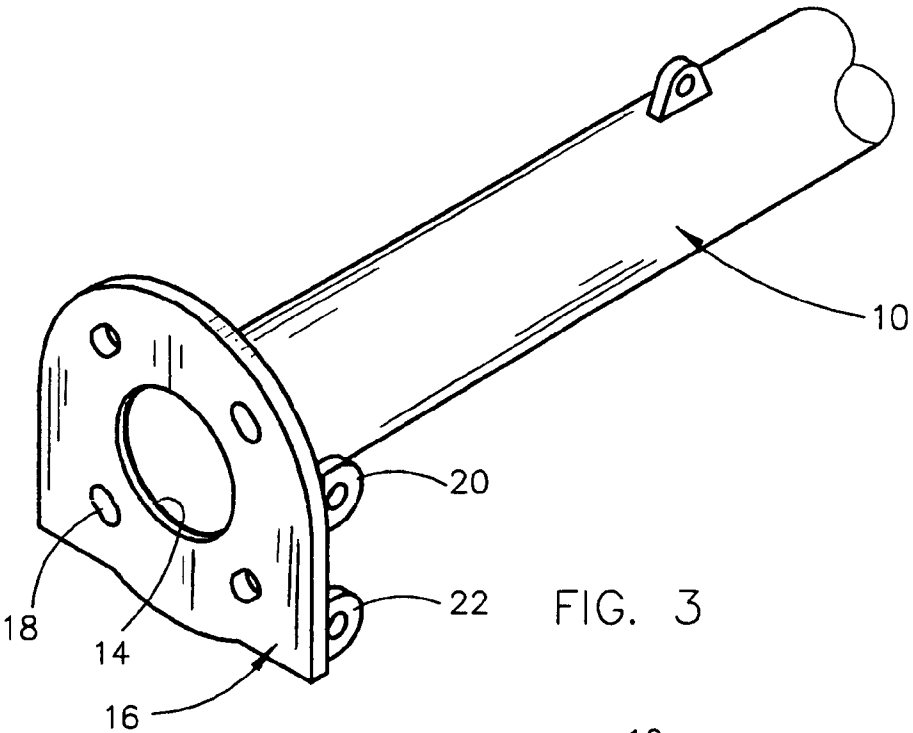
FIG. 3 is a perspective view of the lower end of the pole.
Figure 5:
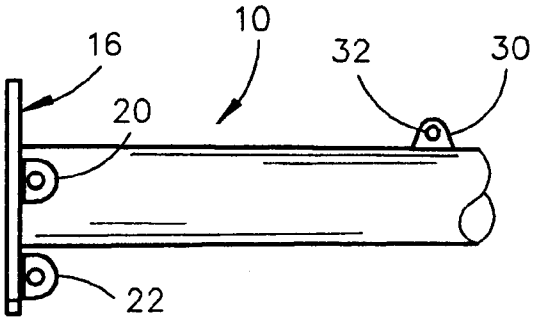
FIG. 5 is a partial side view of the pole.
Figure 6:
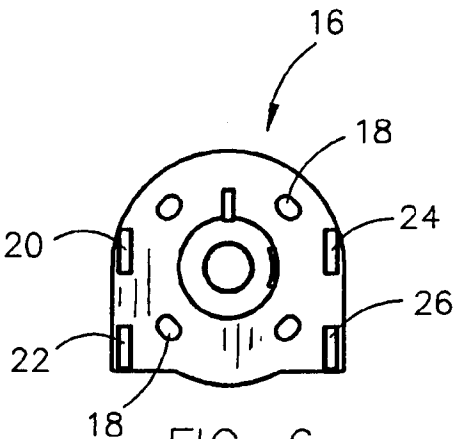
FIG. 6 is a top view of the pole.
Figure 4:
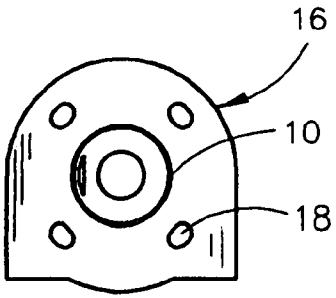
FIG. 4 is a bottom view of the pole.
Figure 7:
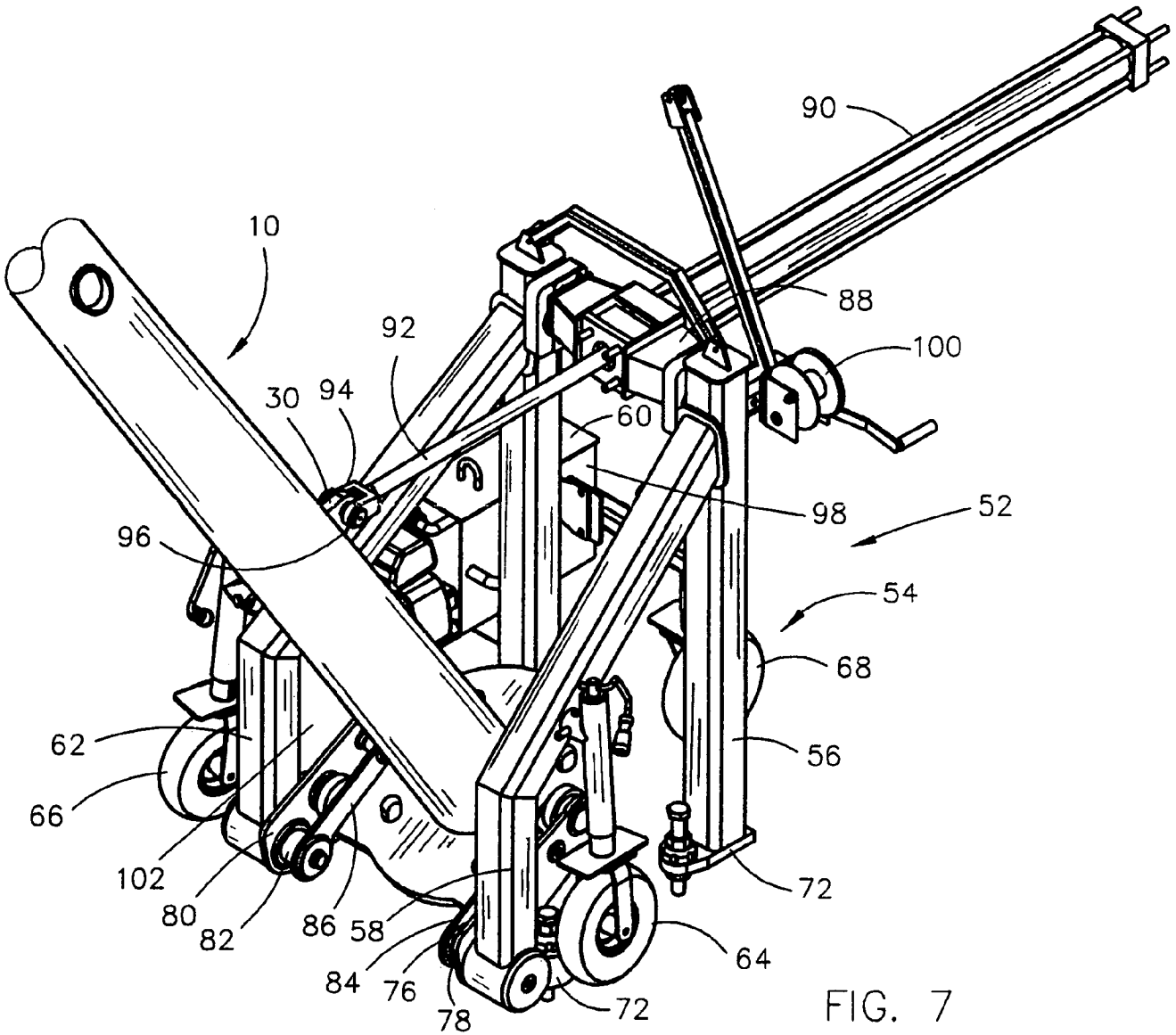
FIG. 7 is a perspective view of the apparatus which is employed to raise and lower the pole which is partially illustrated.
Figure 8:
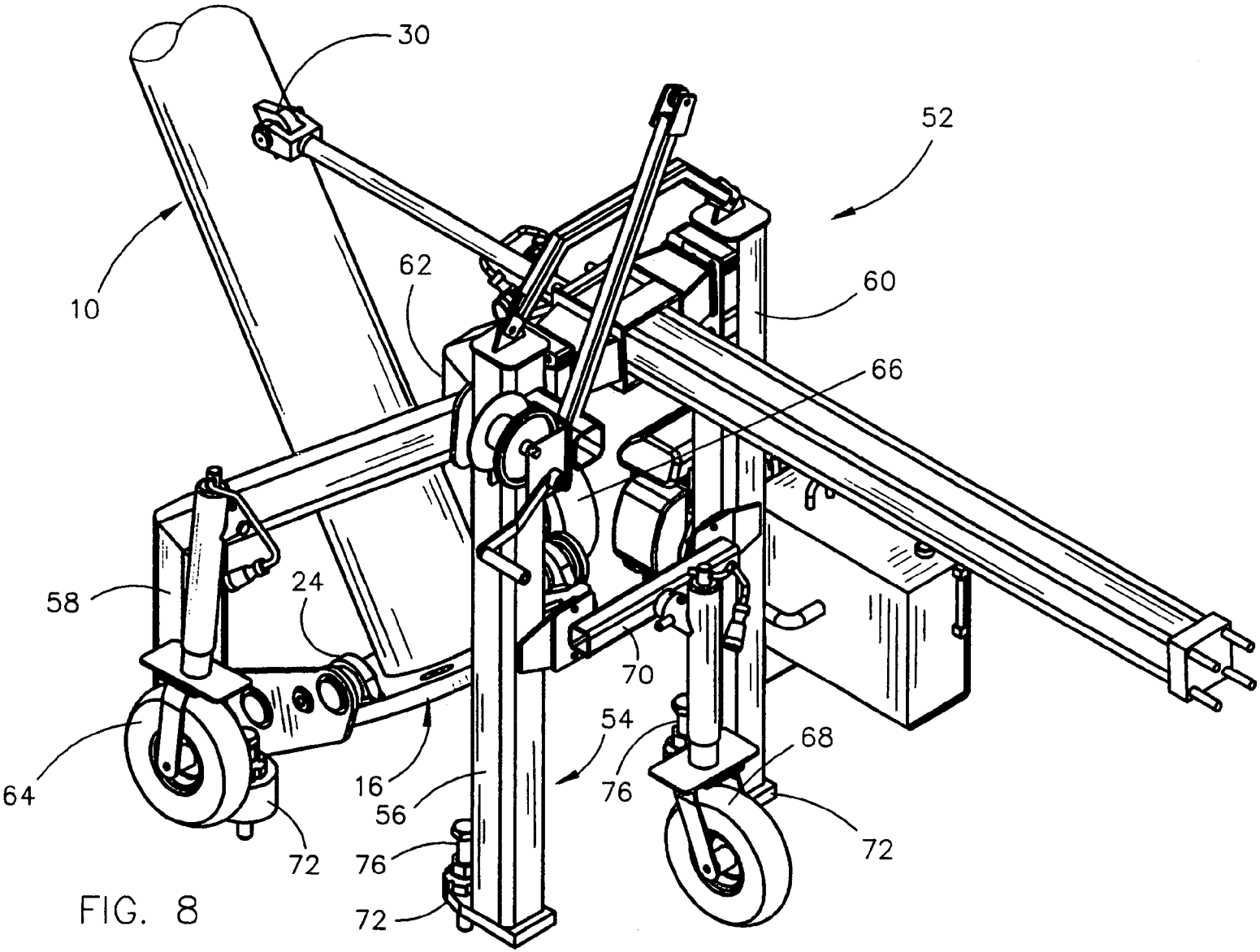
FIG. 8 is a perspective view similar to that of FIG. 7 except taken at a different angle.
Figure 9:
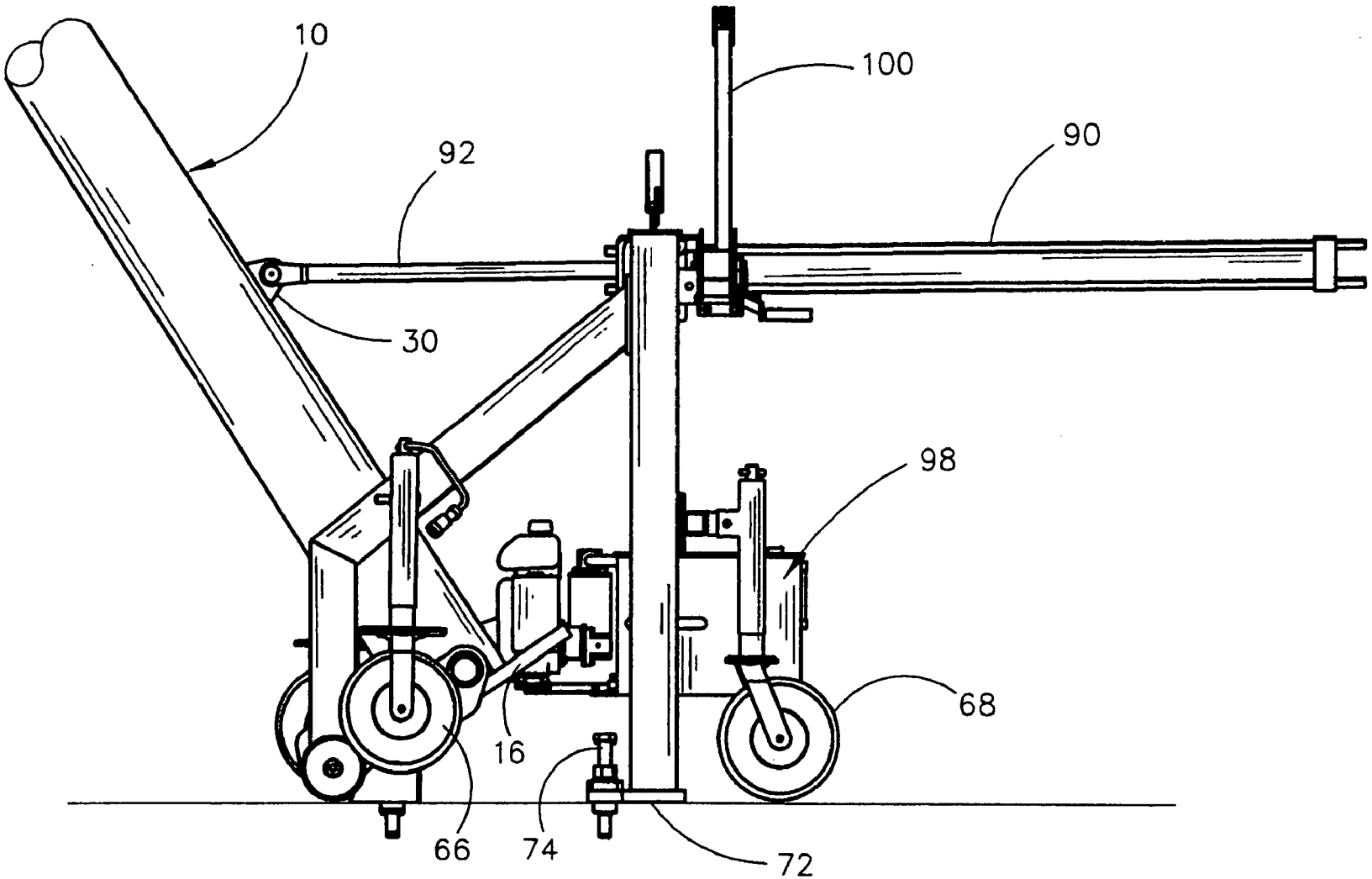
FIG. 9 is a side view of the apparatus for raising and lowering the pole which is partially shown.
Figure 10:
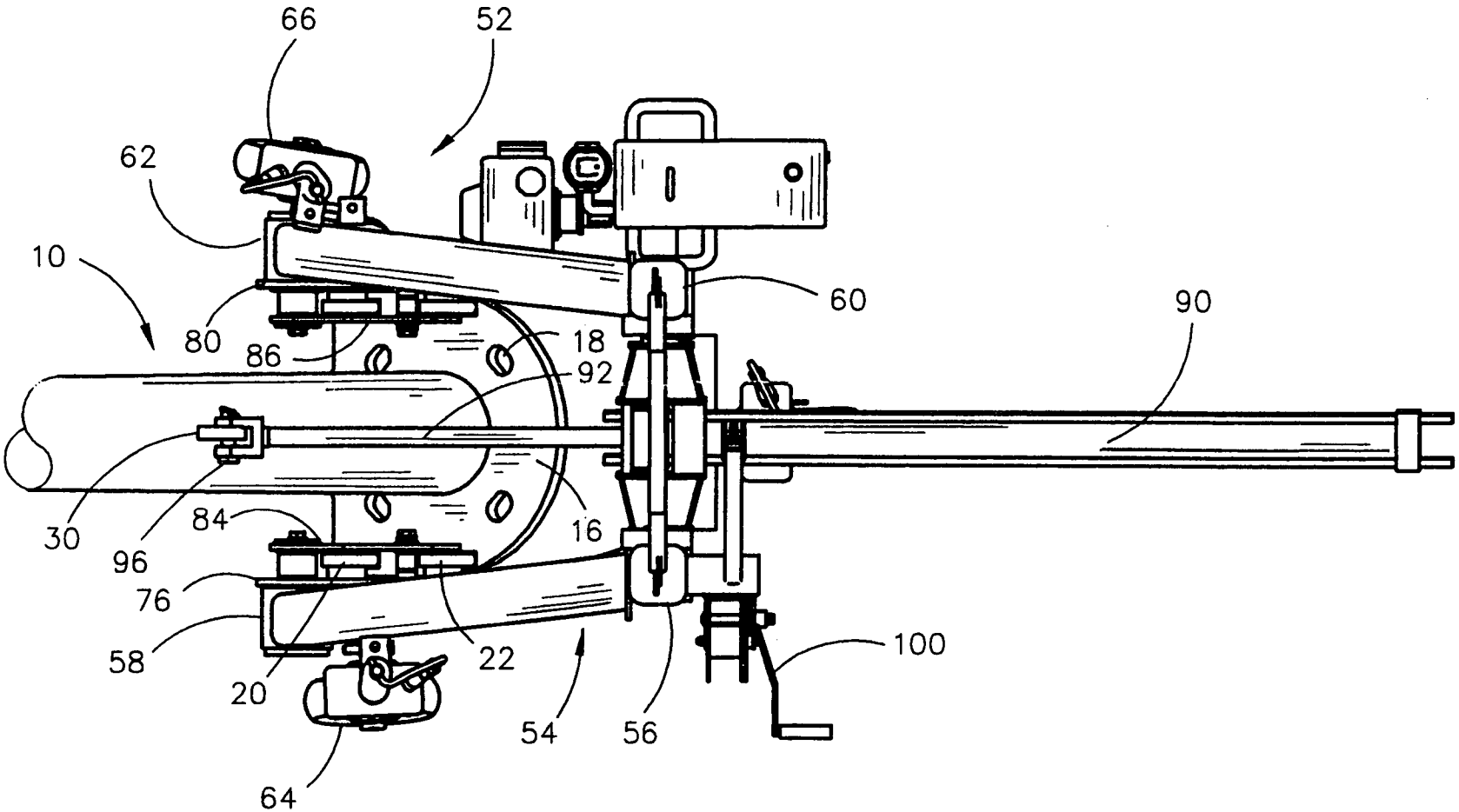
FIG. 10 is a top view of the pole and apparatus of FIG. 9.
Figure 11:
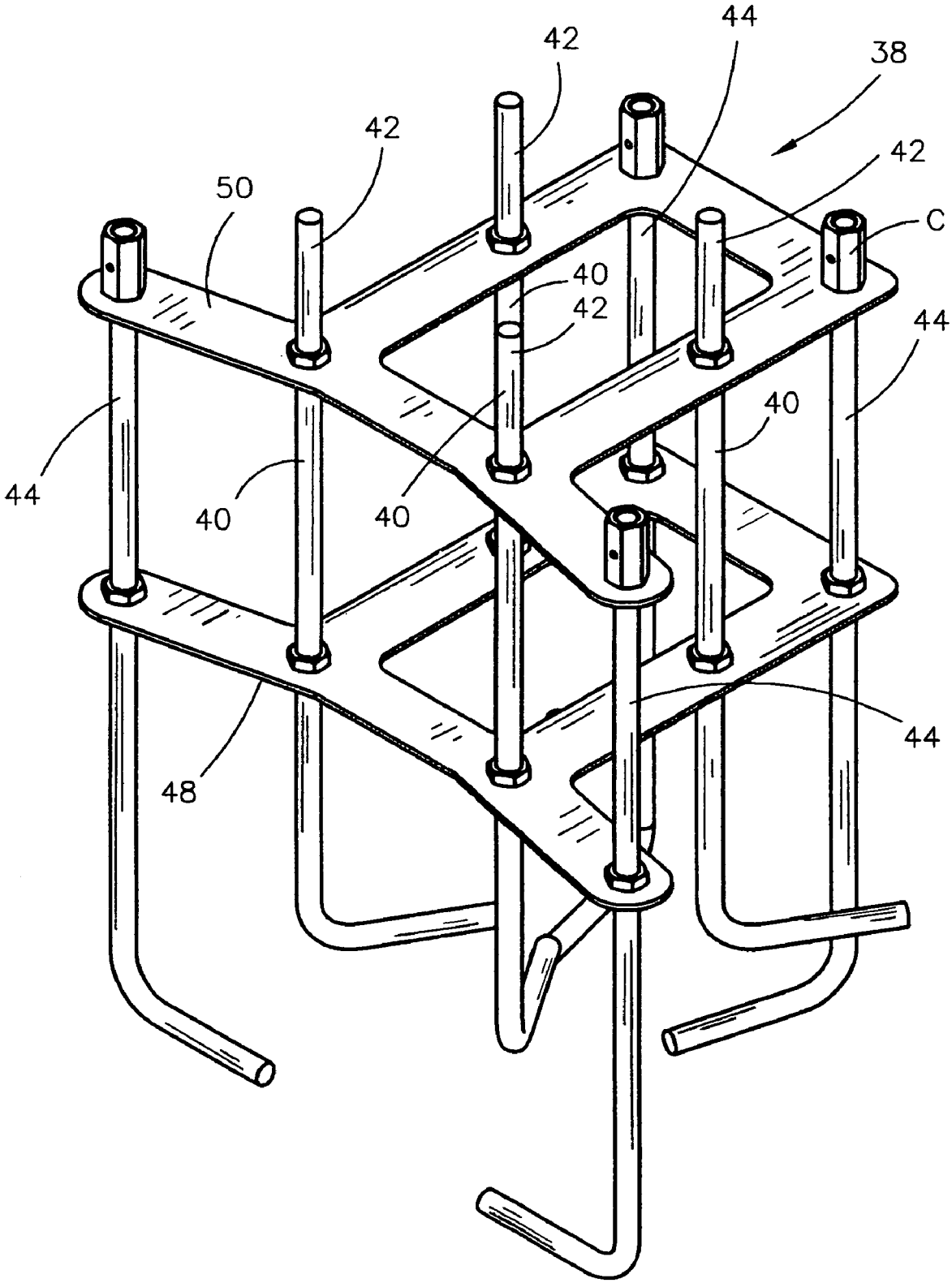
FIG. 11 is a perspective view of the anchor structure.
Figure 12:
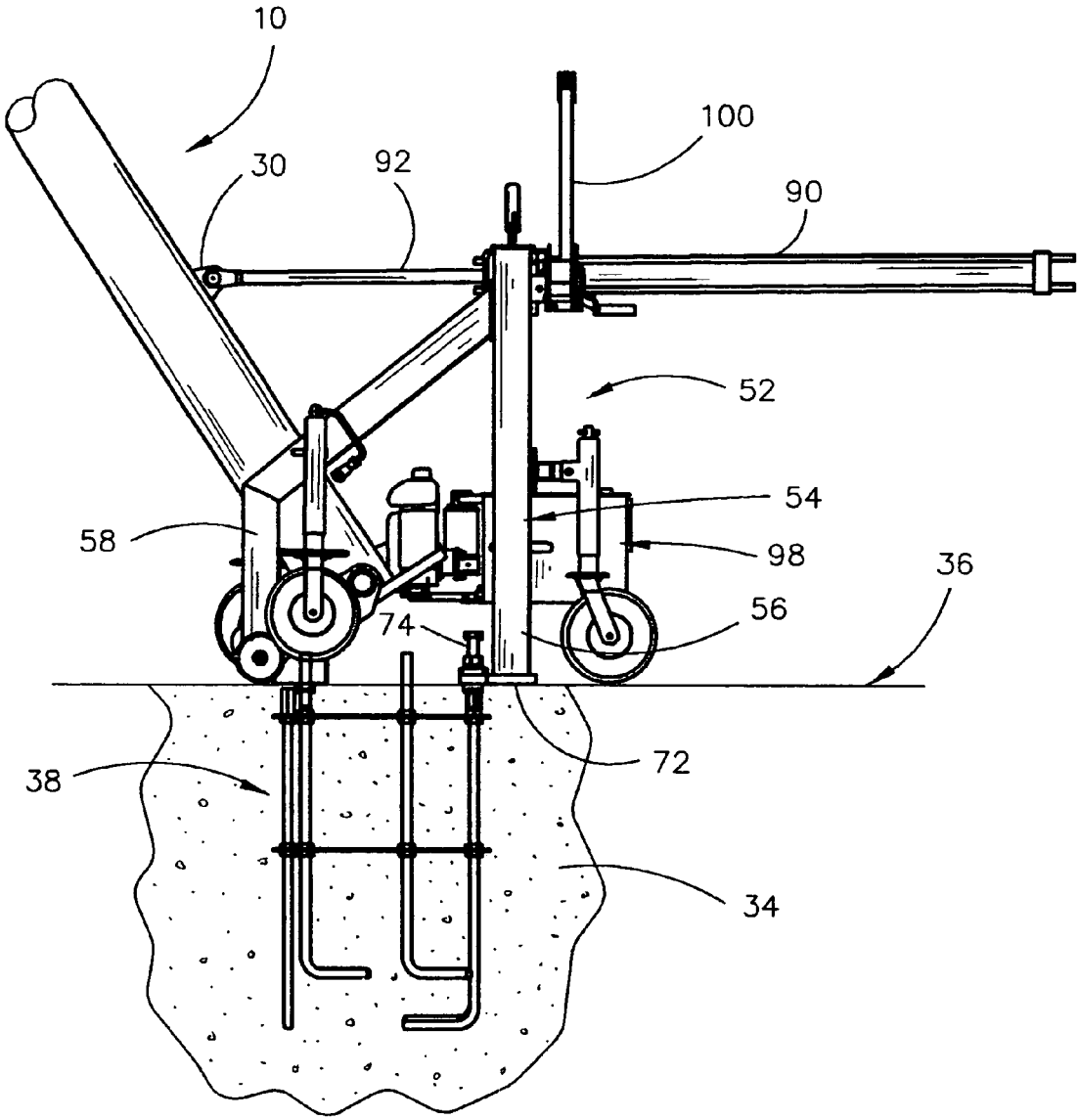
FIG. 12 is a side view illustrating the relationship between the anchor structure of FIG. 11 and the apparatus for raising and lowering the pole.

The hinged pole of this invention is referred generally by the reference numeral 10 and includes an upper end 12 and a lower end 14. Base plate 16 is secured to the lower end 14 of pole 10 by welding. Base plate 16 is provided with an array of bolt openings 18 formed therein which are elongated. A pair of upstanding brackets 20 and 22 are secured to base plate 16 at one side thereof and extend upwardly therefrom. Similarly, a pair of upstanding brackets 24 and 26 are secured to base plate 16 at the other side thereof and extend upwardly therefrom. The brackets 20, 22, 24 and 26 are provided with holes formed therein. Bracket 30 is secured to pole 10 above the lower end thereof and which has an opening 32 formed therein.

The numeral 34 refers to a concrete foundation, the upper end of which is preferably flush with the ground 36. Foundation 34 includes an anchor bolt and template assembly 38 including a plurality of upstanding anchor rods 40 having threaded upper ends 42. Rebar assembly 38 also includes a plurality of upstanding anchor rods 44 having threaded upper ends onto which are secured couplers 46 which are embedded in the foundation. Couplers 46 could also be replaced by commercially available threaded inserts. Templates 48 and 50 are connected to the anchor rods 40 and 44, as seen in the drawings.

The numeral 52 refers to an apparatus for hingedly moving the pole which is in the form of a cart. Cart 52 includes a frame 54 having legs or frame members 56, 58, 60 and 62. A vertically movable wheel assembly 64 is operatively secured to leg 58 while vertically movable wheel assembly 66 is operatively secured to leg 62. A vertically movable wheel assembly 68 is operatively secured to frame member 70 which extends between legs 56 and 60. The wheel assemblies 64, 66 and 68 are of the crank type such as commonly used to support the tongues or hitches of boat trailers or the like. The wheel assemblies 64, 66 and 68 are selectively vertically movable from a lowered position wherein the lower ends of the legs 56, 58, 60 and 62 are positioned above the ground to a raised position wherein the lower ends of the legs 56, 58, 60 and 62 will be in engagement with a supporting surface such as the upper surface of the foundation 34. Supports 72 are secured to the lower ends of legs 56, 58, 60 and 62 and have threaded leveling bolts threadably mounted thereon.

Arm or link 76 has one end thereof pivotally connected to the lower end of leg 58 at 78. Arm or link 80 is pivotally connected to the lower end of leg 62 at 82. Stabilizer links 84 and 86 are positioned inwardly of the links 76 and 80, respectively, and are secured thereto, as seen in the drawings. Link 76 is pivotally secured to the brackets 20 and 22 while link 80 is pivotally connected to brackets 24 and 26.

Support 88 is pivotally secured to and extends between the upper ends of legs 56 and 60 and has the base end of a power cylinder 90 secured thereto for pivotal movement therewith. It is preferred that the power cylinder 90 be a hydraulic cylinder but the power cylinder 90 could also be an air cylinder or an electric actuator. Cylinder 90 includes a cylinder rod 92 movably extending therefrom which has a clevis 94 at its outer end. Clevis 94 is selectively secured to bracket 30 by means of bolt 96. It is preferred that a manually operated winch 100 also be provided on the cart 52 so that the power cylinder 90 may be moved to a vertical position with the rod extending downwardly therefrom to enable the cart to be easily transported.

The numeral 98 refers to a power pack which is operatively secured to the cart 52 for movement therewith. If the power cylinder 90 is a hydraulic cylinder, the power pack 98 will include an internal combustion engine, hydraulic pump and reservoir. If the power cylinder 90 is an air cylinder, the power pack 98 will include an internal combustion engine, compressor and air tank. Although it is preferred that the power pack 98 be mounted on the cart 52, the power pack 98 could be a separate component which is individually transported to the job site. For purposes of description, the space between the legs 56, 58 and 60, 62 will be referred to as generally U-shaped space 102.

In use, the hinged pole 10 will have its base plate 16 mounted on threaded ends 42 of rods 40 and may include leveling nuts thereon as well as nuts threadably mounted on the threaded ends 42 of the rods 40 to securely maintain base plate 16 on the foundation 34. If it is necessary to service the luminaire or the like on the upper end of the pole 10, the cart 52, with its wheel assemblies 64, 66 and 68 in their lowered position so as to support the legs 56, 58, 60 and 62 above the ground, if wheeled onto the upper end of the foundation 34. When the bolts 74 on the supports 72 are aligned with the couplers 46, the wheel assemblies 64, 66 and 68 are raised so that the lower ends of the legs 56, 58, 60 and 62 rest upon the foundation. The bolts 74 are then threadably secured to the couplers 46 to anchor the cart 52 in position. The link 76 is then secured to the brackets 20 and 22 and the link 80 is secured to the brackets 24 and 26. The clevis 94 on the rod 92 is pivotally connected to the bracket 30 by means of the bolt 96. The nut securing the base plate 16 to the threaded ends 42 of rods 40 are then removed. The hydraulic cylinder 90 is then actuated to cause the rod 92 to be extended therefrom which causes the pole 10 to be pivoted from its upright position to a horizontal position. As the rod 92 is extended, the base plate 16 pivots upwardly with the links 76 and 80 so that the base plate 16 disengages from the rods 40. The elongated configuration of the bolt openings 18 enables the base plate 16 to separate from the rods 40. Once the pole is in its horizontal position, the luminaire or the like may be serviced.

When the servicing has been completed, the hydraulic cylinder 90 is actuated to retract the rod 92 into the body of the cylinder which causes the pole 10 to be pivoted from its horizontal position to its vertical position. The rod 92 is retracted until the base plate 16 is resting on the foundation or the leveling nuts on the rods 40 with the threaded ends 42 of the rods 40 extending through the bolt openings 18. Nuts are then secured to the threaded ends 42 of the rods 40 to secure the pole to the rebar assembly 38 of the foundation 34. The clevis 94 is then disconnected from the bracket 30 and the links 76 and 80 are disconnected from the brackets 20, 22, 24 and 26. The bolts 74 on the supports 72 are disconnected from the couplers 46. The wheel assemblies 64, 66 and 68 are then lowered to raise the lower ends of the legs 56, 58, 60 and 62. The cart 52 may then be removed from the foundation and transported to another location for further use.

It can therefore be seen that a novel hinged pole has been provided as well as a novel apparatus which enables the pole 10 to be pivotally moved downwardly from its vertically disposed position to a horizontally disposed position so that the luminaire or the like on the upper end of the pole may be serviced.

Thus it can be seen that the invention accomplishes at least all of its stated objectives.

We claim:

1. In combination:

a foundation having an upper surface;

a first array of anchor bolts secured to said foundation which extend upwardly from said upper surface thereof;

a second array of anchor bolts secured to said foundation which extend upwardly from said upper surface thereof laterally outwardly of said first array of anchor bolts;

an elongated pole having upper and lower ends;

a base plate secured to said lower end of said pole;

said base plate having an array of anchor bolt openings formed therein adapted to selectively receive said first array of anchor bolts therein;

threaded nuts on said first array of anchor bolts securing said base plate to said first array of anchor bolts;

said base plate having a plurality of upstanding brackets provided thereon;

a transportable cart including a frame, having upper and lower ends, selectively positioned on said foundation at least partially around said lower end of said pole;

said lower end of said frame being selectively secured to said second array of anchor bolts;

connectors on said frame which are selectively secured to said upstanding brackets on said base plate;

an actuator secured to said frame and selectively secured to said pole above said base plate;

said actuator selectively hingedly moving said pole, between raised and lowered positions, when said threaded nuts are removed from said first array of anchor bolts, said connectors on said frame have been secured to said upstanding brackets on said base plate, said actuator has been secured to said pole above said base plate, and said lower end of said frame has been secured to said second array of anchor bolts;

said actuator comprising a power cylinder;

said power cylinder comprising a hydraulic cylinder.

2. The combination of claim 1 wherein a source of hydraulic power for said hydraulic cylinder is mounted on said cart.

3. In combination:

a foundation having an upper surface;

a first array of anchor bolts secured to said foundation which extend upwardly from said upper surface thereof;

a second array of anchor bolts secured to said foundation which extend upwardly from said upper surface thereof laterally outwardly of said first array of anchor bolts;

an elongated pole having upper and lower ends;

a base plate secured to said lower end of said pole;

said base plate having an array of anchor bolt openings formed therein adapted to selectively receive said first array of anchor bolts therein;

threaded nuts on said first array of anchor bolts securing said base plate to said first array of anchor bolts;

said base plate having a plurality of upstanding brackets provided thereon;

a transportable cart including a frame, having upper and lower ends, which may be selectively positioned on said foundation at least partially around said lower end of said pole;

said lower end of said frame being selectively secured to said second array of anchor bolts;

connectors on said frame which are selectively secured to said upstanding brackets on said base plate;

an actuator secured to said frame and selectively secured to said pole above said base plate;

said actuator selectively hingedly moving said pole, between raised and lowered positions, when said threaded nuts are removed from said first array of anchor bolts, said connectors on said frame have been secured to said upstanding brackets on said base plate, said actuator has been secured to said pole above said base plate, and said lower end of said frame has been secured to said second array of anchor bolts;

said cart being wheeled.

4. In combination:

a foundation having an upper surface;

a first array of anchor bolts secured to said foundation which extend upwardly from said upper surface thereof;

a second array of anchor bolts secured to said foundation which extend upwardly from said upper surface thereof laterally outwardly of said first array of anchor bolts;

an elongated pole having upper and lower ends;

a base plate secured to said lower end of said pole;

said base plate having an array of anchor bolt openings formed therein adapted to selectively receive said first array of anchor bolts therein;

threaded nuts on said first array of anchor bolts securing said base plate to said first array of anchor bolts;

said base plate having a plurality of upstanding brackets provided thereon;

a transportable cart including a frame, having upper and lower ends, selectively positioned on said foundation at least partially around said lower end of said pole;

said lower end of said frame being selectively secured to said second array of anchor bolts;

connectors on said frame which are selectively secured to said upstanding brackets on said base plate;

an actuator secured to said frame and selectively secured to said pole above said base plate;

said actuator selectively hingedly moving said pole, between raised and lowered positions, when said threaded nuts are removed from said first array of anchor bolts, said connectors on said frame have been secured to said upstanding brackets on said base plate, said actuator has been secured to said pole above said base plate, and said lower end of said frame has been secured to said second array of anchor bolts;

said cart including a plurality of selectively vertically movable support wheels.

5. In combination:

a foundation having an upper surface;

a first array of anchor bolts secured to said foundation which extend upwardly from said upper surface thereof;

a second array of anchor bolts secured to said foundation which extend upwardly from said upper surface thereof laterally outwardly of said first array of anchor bolts;

an elongated pole having upper and lower ends;

a base plate secured to said lower end of said pole;

said base plate having an array of anchor bolt openings formed therein adapted to selectively receive said first array of anchor bolts therein;

threaded nuts on said first array of anchor bolts securing said base plate to said first array of anchor bolts;

said base plate having a plurality of upstanding brackets provided thereon;

a transportable cart including a frame, having upper and lower ends, selectively positioned on said foundation at least partially around said lower end of said pole;

said lower end of said frame being selectively secured to said second array of anchor bolts;

connectors on said frame which are selectively secured to said upstanding brackets on said base plate;

an actuator secured to said frame and selectively secured to said pole above said base plate;

said actuator selectively hingedly moving said pole, between raised and lowered positions, when said threaded nuts are removed from said first array of anchor bolts, said connectors on said frame have been secured to said upstanding brackets on said base plate, said actuator has been secured to said pole above said base plate, and said lower end of said frame has been secured to said second array of anchor bolts;

said frame of said cart including a back frame section and opposite side frame sections which generally define a U-shaped space therebetween which receives said pole.

6. In combination:

a foundation having an upper surface;

a first array of anchor bolts secured to said foundation which extend upwardly from said upper surface thereof;

a second array of anchor bolts secured to said foundation which extend upwardly from said upper surface thereof laterally outwardly of said first array of anchor bolts;

an elongated pole having upper and lower ends;

a base plate secured to said lower end of said pole;

said base plate having an array of anchor bolt openings formed therein adapted to selectively receive said first array of anchor bolts therein;

threaded nuts on said first array of anchor bolts securing said base plate to said first array of anchor bolts;

said base plate having a plurality of upstanding brackets provided thereon;

a transportable cart including a frame, having upper and lower ends, which may be selectively positioned on said foundation at least partially around said lower end of said pole;

said lower end of said frame being selectively secured to said second array of anchor bolts;

connectors on said frame which are selectively secured to said upstanding brackets on said base plate;

an actuator secured to said frame and selectively secured to said pole above said base plate;

said actuator selectively hingedly moving said pole, between raised and lowered positions, when said threaded nuts are removed from said first array of anchor bolts, said connectors on said frame have been secured to said upstanding brackets on said base plate, said actuator has been secured to said pole above said base plate, and said lower end of said frame has been secured to said second array of anchor bolts;

said frame including upstanding leg portions having lower ends; said lower ends of said leg portions being selectively secured to said second array of anchor bolts.

7. In combination:

a foundation having an upper surface;

a first array of anchor bolts secured to said foundation;

an elongated pole having upper and lower ends;

a base plate secured to said lower end of said pole;

said base plate having an array of anchor bolt openings formed therein adapted to selectively receive said first array of anchor bolts therein;

said base plate having a plurality of upstanding brackets provided thereon;

a transportable cart including a frame, having upper and lower ends, selectively positioned on said foundation adjacent said pole;

said frame being selectively secured to said foundation;

an actuator secured to said frame and selectively secured to said pole above said base plate;

said actuator selectively hingedly moving said pole, between raised and lowered positions with respect to said foundation;

said cart being wheeled.

8. In combination:

a foundation having an upper surface;

a first array of anchor bolts secured to said foundation;

an elongated pole having upper and lower ends;

a base plate secured to said lower end of said pole;

said base plate having an array of anchor bolt openings formed therein adapted to selectively receive said first array of anchor bolts therein;

said base plate having a plurality of upstanding brackets provided thereon;

a transportable cart including a frame, having upper and lower ends, selectively positioned on said foundation adjacent said pole;

said frame being selectively secured to said foundation;

an actuator secured to said frame and selectively secured to said pole above said base plate;

said actuator selectively hingedly moving said pole, between raised and lowered positions with respect to said foundation;

said cart including a plurality of selectively vertically movable support wheels.

9. In combination:

a foundation having an upper surface;

a first array of anchor bolts secured to said foundation;

an elongated pole having upper and lower ends;

a base plate secured to said lower end of said pole;

said base plate having an array of anchor bolt openings formed therein adapted to selectively receive said first array of anchor bolts therein;

said base plate having a plurality of upstanding brackets provided thereon;

a transportable cart including a frame, having upper and lower ends, selectively positioned on said foundation adjacent said pole;

said frame being selectively secured to said foundation;

an actuator secured to said frame and selectively secured to said pole above said base plate;

said actuator selectively hingedly moving said pole, between raised and lowered positions with respect to said foundation;

said frame of said cart including a back frame section and opposite side frame sections which generally define a U-shaped space therebetween which receives said pole.

10. In combination:

a foundation having an upper surface;

a first array of anchor bolts secured to said foundation;

an elongated pole having upper and lower ends;

a base plate secured to said lower end of said pole;

said base plate having an array of anchor bolt openings formed therein adapted to selectively receive said first array of anchor bolts therein;

said base plate having a plurality of upstanding brackets provided thereon;

a transportable cart including a frame, having upper and lower ends, selectively positioned on said foundation adjacent said pole;

said frame being selectively secured to said foundation;

an actuator secured to said frame and selectively secured to said pole above said base plate;

said actuator selectively hingedly moving said pole, between raised and lowered positions with respect to said foundation;

said frame including upstanding leg portions having lower ends; said lower ends of said leg portions being selectively secured to said foundation.

* * * * *